US008777081B2

(12) United States Patent
Chen et al.

(10) Patent No.: US 8,777,081 B2
(45) Date of Patent: Jul. 15, 2014

(54) POWER TOOL WITH AN AUTOMATIC NAIL-FEEDING MECHANISM

(75) Inventors: Liang Chen, Nanjing (CN); Hongtao Zhou, Nanjing (CN); Yijie Yang, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 232 days.

(21) Appl. No.: 13/217,951

(22) Filed: Aug. 25, 2011

(65) Prior Publication Data

US 2012/0061443 A1 Mar. 15, 2012

(30) Foreign Application Priority Data

Sep. 9, 2010 (CN) ..... 2010 1 0285588

(51) Int. Cl.
*B25C 1/00* (2006.01)

(52) U.S. Cl.
USPC ..... 227/119; 227/113

(58) Field of Classification Search
USPC ..... 227/113, 119, 135, 136, 146
See application file for complete search history.

(56) References Cited

U.S. PATENT DOCUMENTS

| | | | | |
|---|---|---|---|---|
| 2,938,213 | A * | 5/1960 | Gorn | 227/113 |
| 3,944,067 | A * | 3/1976 | Bakoledis | 206/347 |
| 4,478,112 | A * | 10/1984 | Moulton | 81/57.37 |
| 4,674,367 | A * | 6/1987 | Aab et al. | 81/57.37 |

* cited by examiner

*Primary Examiner* — Thanh Truong
*Assistant Examiner* — Nathaniel Chukwurah
(74) *Attorney, Agent, or Firm* — Greenberg Traurig, LLP

(57) ABSTRACT

An automatic nail-feeding mechanism for a power tool having a striking assembly having a striking rod movable in a linear reciprocating manner feeds a nail to be struck to a front end of the striking rod. The automatic nail-feeding mechanism has a driving part movable between a first position and a second position in a direction of a reciprocating motion of the striking rod and a nail-storing element is provided with nails arranged at a fixed pitch, the nail-storing element being fed a distance of the fixed pitch towards the striking rod when the driving part moves from the first position to the second position and then from the second position to the first position in a stroke of the reciprocating motion thereof.

14 Claims, 7 Drawing Sheets

5a

5b

5c

POWER TOOL WITH AN AUTOMATIC NAIL-FEEDING MECHANISM

RELATED APPLICATION DATA

This application claims the benefit of CN 201010285588.1, filed on Sep. 9, 2010, the disclosure of which is incorporated herein by reference in its entirety.

BACKGROUND

The following generally relates to a power tool for striking a fastening piece into a workpiece and, more specifically, to a nail-feeding mechanism which can feed a fastening piece to a striking position of the power tool.

Currently, fastening pieces, such as nails and the like, used in connection with power tools, such as electric nailers, are unpacked. Thus, once a nail is struck into the workpiece, the users must take some time to place another nail at the striking position before a next striking operation. Such an operation has low efficiency.

An existing gas nailer discloses an automatic nail-feeding system. The automatic nail-feeding system comprises a housing and a front end assembly movably connected to the housing. The front end assembly is provided with a passage through which a striking rod and a nail to be struck can pass. The front end assembly further comprises an automatic nail-feeding assembly which can feed the next nail to be struck to the passage once a striking operation for one nail is finished. The nails to be struck are stored in a nail-storing element in advance. However, such an existing nail-storing element is designed for a professional user and, as a result, has a volume which is large and not compact. It is impossible for users to fill unpacked nails into this nail-storing element in advance and, as a result, they have to use packed nails which need to be bought in bulk, and the cost is then high. Hence, such a device is not practical for common do it yourself (DIY) users.

SUMMARY

Described hereinafter is a power tool with an automatic nail-feeding mechanism which can automatically feed nails to a position for striking. To this end, the power tool includes a striking assembly having a striking rod movable in a linear reciprocating manner and an automatic nail-feeding mechanism for automatically feeding a nail to be struck to the front end of the striking rod. The automatic nail-feeding mechanism further includes a driving part movable between a first position and a second position in a direction of reciprocating motion of the striking rod and a nail-storing element being provided with nails arranged at a fixed pitch. The nail-storing element is fed a distance of the fixed pitch towards the striking rod when the driving part moves from the first position to the second position and then from the second position to the first position in a stroke of the reciprocating motion thereof.

Preferably, the first position is a position where the front end surface of the driving part is farthest from the front end surface of the striking rod and the second position is a position where the front end surface of the driving part is nearest to the front end surface of the striking rod.

The power tool may also include a feed mechanism drivably arranged between the driving part and the nail-storing element, the feed mechanism comprising guide grooves and a driving element engagable with the guide grooves.

The guide grooves may comprise skewed slots formed on the nail-storing element. Further, a skewed tooth may be formed between two adjacent skewed slots, the tooth surface at one side of the skewed tooth being a vertical surface and the tooth surface at the other side thereof being an inclined surface or a curved surface.

The driving element may comprises a retractable convex piece arranged on the driving part.

A first spring element may be provided to act on the convex piece for biasing it towards the guide grooves.

The automatic nail-feeding mechanism may also comprise a locking mechanism for locking the nail-storing element in a single direction.

The nails to be struck may be arranged on the nail-storing element in a direction perpendicular to the striking rod.

The automatic nail-feeding mechanism may also comprise a rotating mechanism for rotating the nail to be stricken from a position where the nail is perpendicular to the striking rod to a position where the nail is parallel to the striking rod.

The rotating mechanism may comprise a rack portion formed on the driving part and a pinion portion formed on a rotary element for engaging with the rack portion.

The rack portion may have such a length that the rotary element can be driven to rotate 90 degrees.

The pinion portion may have a first end which comes into engaging with the rack portion in the beginning and a second end which engages with the rack portion in the end, the first end making an angle of 90 degrees with the second end.

The rotary element may be provided with an extension arm having a magnetic element thereon.

The automatic nail-feeding mechanism may further comprise a second spring element for biasing the driving part towards the first position.

The automatic nail-feeding mechanism may also comprise a third spring element for allowing for a reverse rotation of the rotary element.

By adopting the above technical solution, it can obtain the following advantageous technical effects:

1) The subject device has a nail-storing element which can be filled by users themselves with unpacked nails, and the nail-storing element is able to move automatically, that is, it is unnecessary for users to manually place a nail in a needed position;

2) Since the nails in the nail-storing element are arranged parallel to the housing of the machine, various kinds of nails with different sizes can be used therein; and 3) The rotating mechanism can hold the nail and convey it to a stricken position.

Other features and advantages will be understood from the detail explanation provided hereinafter.

BRIEF DESCRIPTION OF THE DRAWINGS

The subject device will be explained hereinafter with reference to the accompanying drawings, wherein:

FIG. 5 is a schematic view of the nail-storing element showing the feed process thereof, wherein FIG. 5*a* shows a pre-feed state, FIG. 5*b*, shows a partial-feed state and FIG. 5*c*, shows a full-feed state in which the nail-storing element has moved into a next nail-storing position;

DETAILED DESCRIPTION

Figure 1:
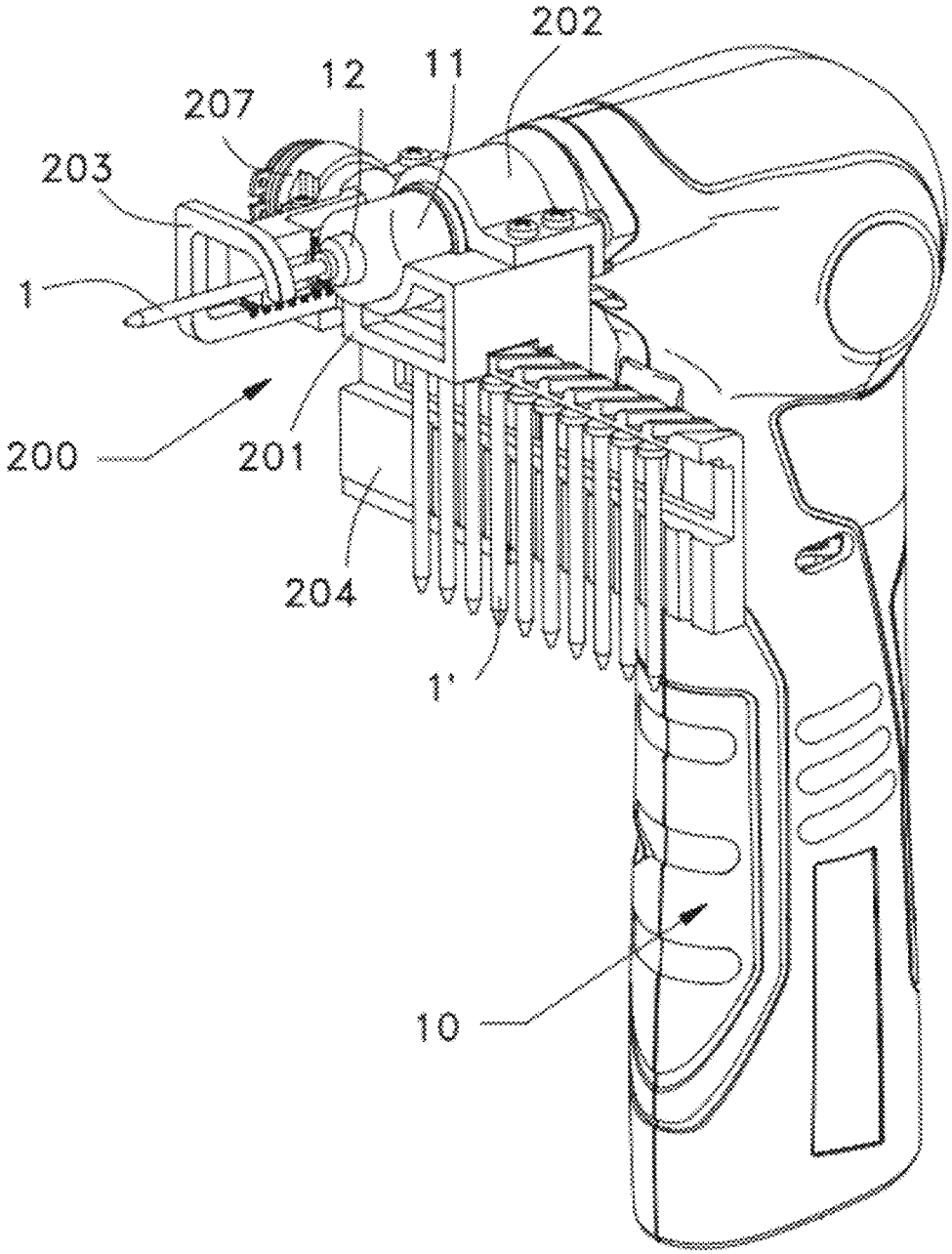
FIG. 1 is a schematic view of an exemplary power tool with an exemplary automatic nail-feeding mechanism constructed according to a preferred embodiment.

As shown in FIG. 1, an electric hammer includes a machine body 10. As the internal mechanism and working principle of the machine body 10 are conventional, detailed description thereof is omitted for the sake of brevity. Nevertheless, a front end assembly 11 at the front end of the machine body 10 has a striking rod 12 protruding therefrom and movable in a reciprocating manner. The striking rod 12 in its front end surface can strike on the cap portion of a fastening piece such as a nail 1. The nail 1 at a position for striking is held by an automatic nail-feeding mechanism 200 mounted on the front end assembly 11. The automatic nail-feeding mechanism 200 mainly comprises an upper cover 202, a lower cover 201, a driving mechanism comprising a driving part 203 movable along a reciprocating movement direction of the striking rod 12, a feed mechanism comprising a nail-storing element 204 movable towards the striking rod 12, a movement-locking mechanism and a rotating mechanism comprising a rotary element 207 in rack-and-pinion engagement with the driving part 203. The nail-storing element 204 is provided with the nails 1' to be struck which are arranged at a fixed pitch thereon.

Figure 2:
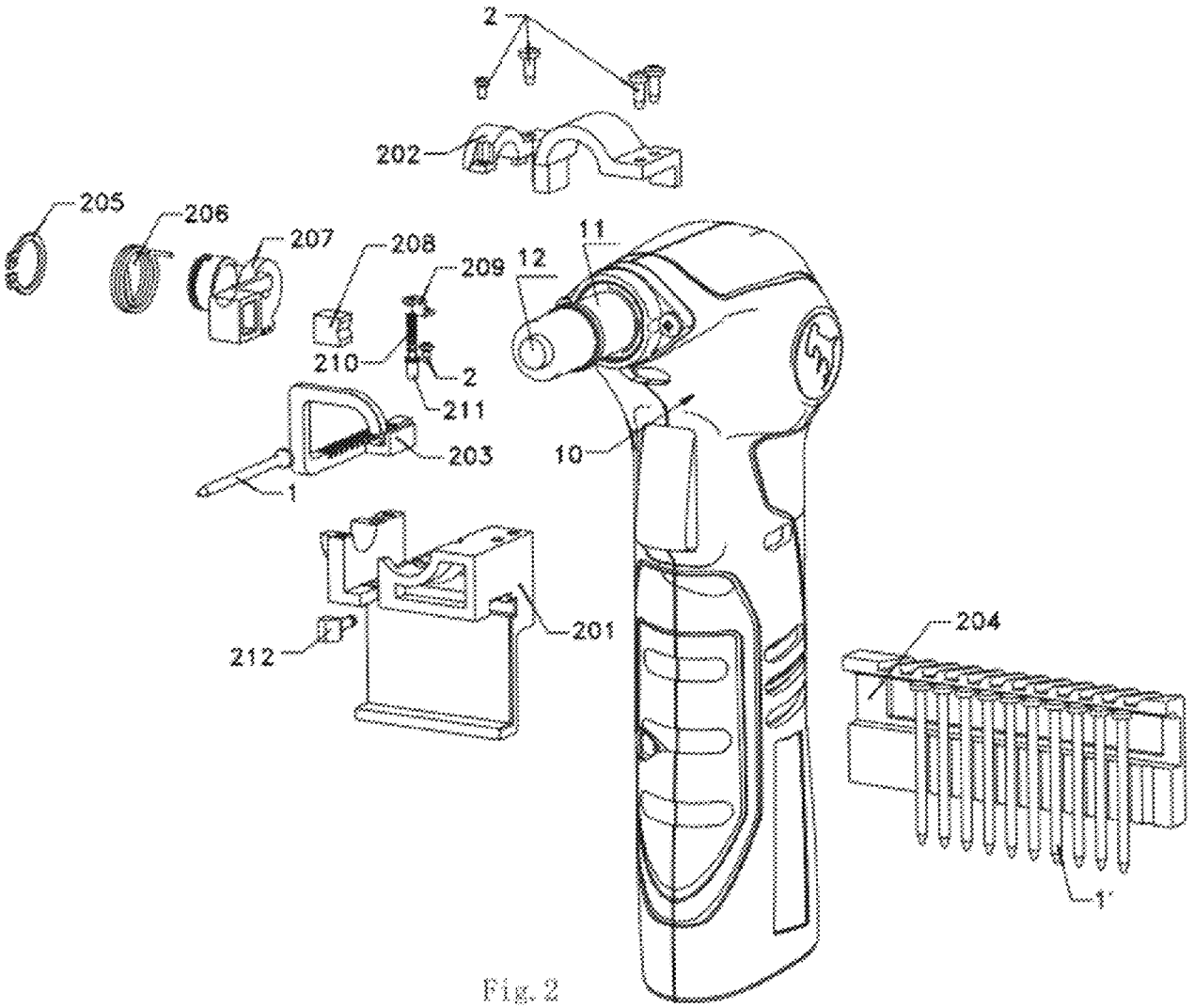
FIG. 2 is an exploded view of the power tool with the automatic nail-feeding mechanism.
Figure 3:
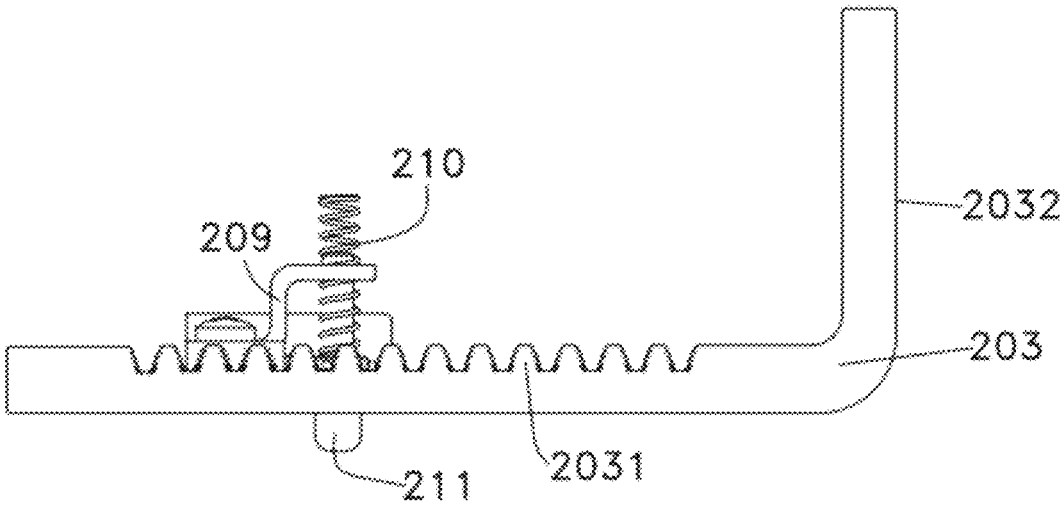
FIG. 3 is a schematic view of a driving part of the automatic nail-feeding mechanism.
Figure 4:
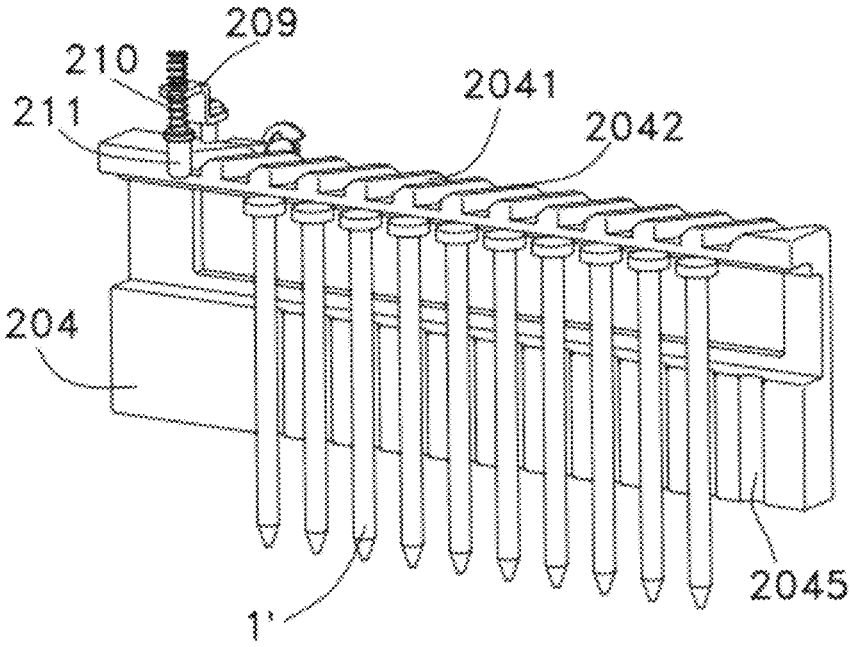
FIG. 4 is a schematic view of a nail-storing element of the automatic nail-feeding mechanism.

Referring to FIG. 2, the positional connecting relation between the parts of the automatic nail-feeding mechanism will be further described in detail. The upper cover 202 and the lower cover 201 are each provided with an arched portion for mounting on the front end assembly 11 in a cylindrical shape, and the upper cover 202 and the lower cover 201 are fixed through screws 2. The driving part 203 is mounted between the upper and lower covers 202, 201. Referring to FIG. 1, the front end surface of the driving part 203 is beyond the front end surfaces of the upper and lower covers 202, 201 so that it contacts with the workpiece firstly during striking of a nail and is pushed backward by the workpiece. Referring to FIG. 3, the driving part 203 is formed with a hole through which a pin 211 passes so that the pin 211 can move up and down therein. A first spring 210 is provided for biasing the pin 211 downwards via a retainer 209. Referring to FIG. 4, the pin 211 is engaged with the skewed slot 2041 on the top end of the nail-storing element 204 so that the nail-storing element 204 can be moved to get a feed. The nail-storing element 204 is mounted on the lower cover 201, with the nails 1' to be stricken filled therein being perpendicular to the striking rod 12. It is noted that various kinds of the nails with different sizes can be held in the nail-storing element 204 without interfering with the workpiece.

Figure 5:
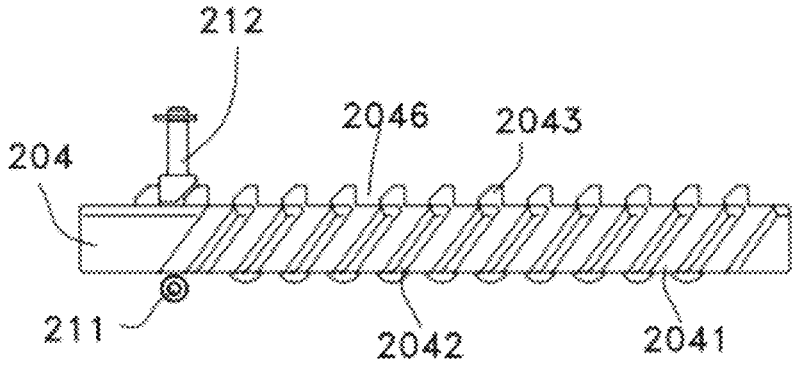
Figure 5:
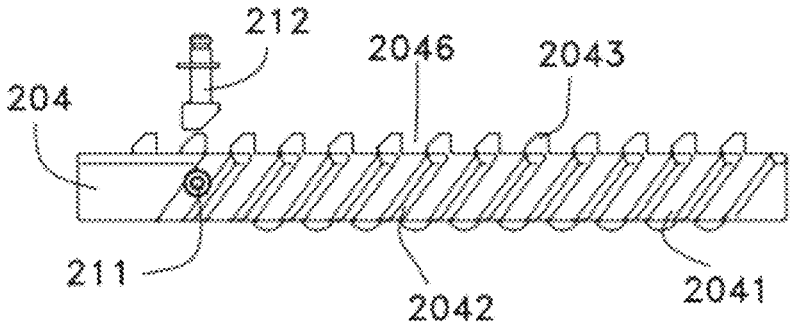
Figure 5:
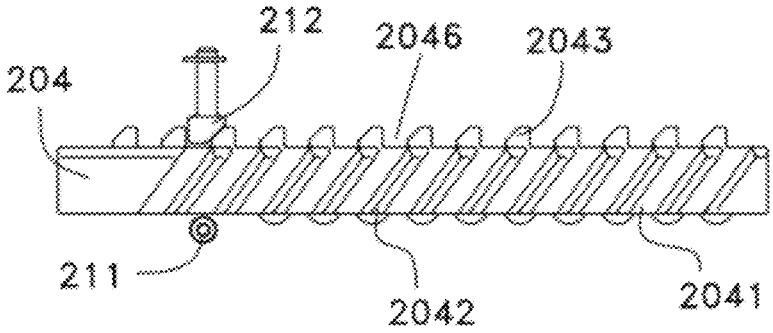
Figure 7:
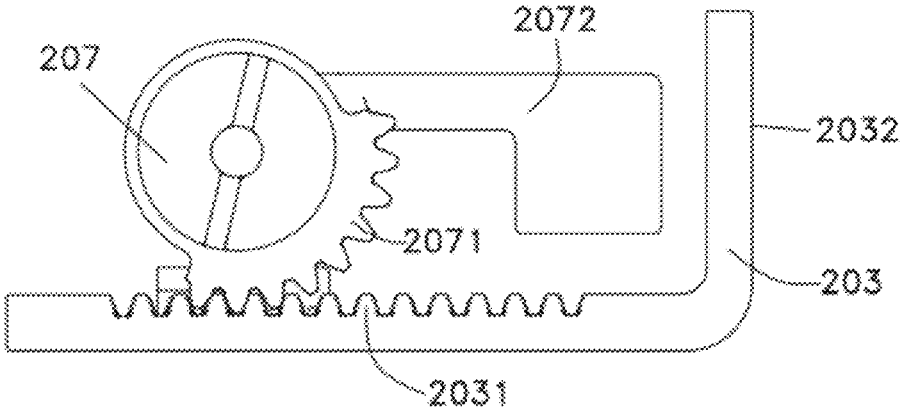
FIG. 7 is a schematic view of an exemplary rotating mechanism of the automatic nail-feeding mechanism.

Referring back to FIGS. 2, 3 and 7, the driving part 203 is provided with a rack portion 2031 thereon, and the rotary element 207 is provided with a pinion portion 2071 for engaging with the rack portion 2031. The rotary element 207 is mounted at the side corresponding to the feed direction of the nail-storing element 204 and is provided with a third spring 206 for biasing the rotary element to rotate in an opposite direction and a collar 205 for retaining the third spring 206. Once a nail 1 is struck into the workpiece and the operation thereof is completed, the electric hammer will be moved away from the workpiece, as a result, the third spring 206 will, in the case that the external urging force from the workpiece disappears, bias the rotary element 207 to rotate reversedly so as to drive indirectly the driving part 203 to move forwards. It will be understood that, it is easily conceivable for the skilled person in the art that a second spring (not shown) for replacing the third spring can act directly on the driving part 203 for enabling the driving part 203 to move forwards. Further, the rotary element 207 is provided with an extension arm 2072 protruding outside. A magnetic element 208 is mounted in the extension arm 2072 for holding the nail 1 in its position for striking FIG. 5 shows series of statuses of the nail-storing element 204 in a feed-movement process, wherein FIG. 5*a* shows that the pin 211 is located at the opening of a first skewed slot 2041, FIG. 5*b* shows that the pin 211 is driven by the driving part 203 to move towards the middle portion of the first skewed slot 2041 and then to drive the nail-storing element 204 to move in a feed-movement, and FIG. 5*c* shows that the pin 211 is slid back to the opening of a second skewed slot 2041 for the next feeding cycle. A skewed tooth 2042 is formed between two adjacent skewed slots 2041. As shown in FIG. 4, the tooth surface at one side of the skewed tooth 2042 is a vertical surface against which the pin 211 abuts when the pin 211 is impelled within the skewed slot 2041, while the tooth surface at the other side thereof is an inclined surface along which the pin 211 slides when it is retreated back to the opening of the next skewed slot 2041 from one skewed slot due to the second spring mounted on the pin 211. The skewed slots 2041 have a pitch therebetween which is corresponding to the nail-retaining groove 2045 on the nail-storing element 204 one-to-one.

Though the skewed tooth 2042 in this embodiment has an inclined surface, it may also adopt a curved surface in other embodiments for allowing for the pin 211 to slide thereon.

Figure 6:
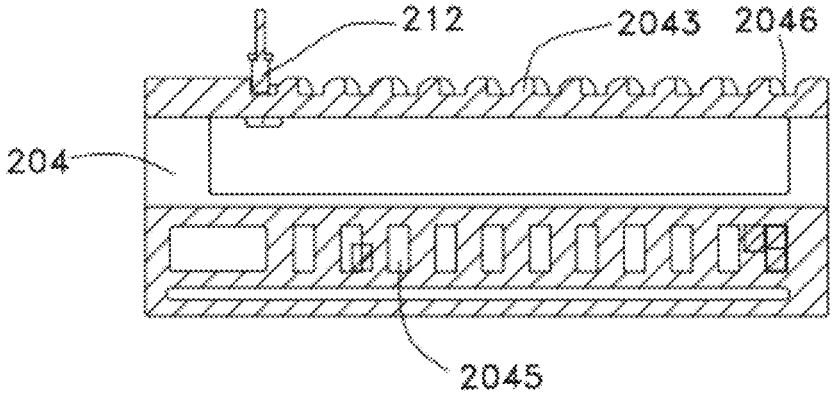
FIG. 6 is a schematic view of the nail-storing element with an exemplary single-directional locking mechanism.
Figure 8:
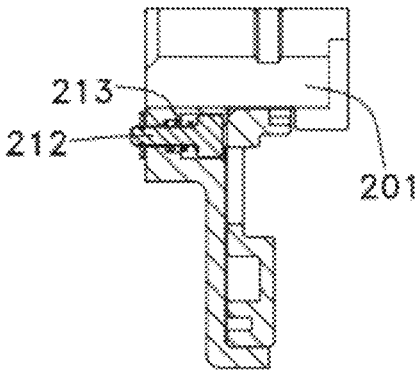
FIG. 8 is a schematic view showing the installation of a locking piece of the single-directional locking mechanism in FIG. 6.

FIGS. 6 and 8 are schematic views of the locking mechanism. The locking mechanism comprises locking grooves 2046 formed on the nail-storing element 204 and a locking pin 212 mounted on the lower cover 201 for engaging with the locking grooves. A biasing spring element 213 is arranged on the locking pin 212. Locking tooth 2043 is formed between two adjacent locking grooves 2046, with one side tooth surface thereof being formed as a vertical surface and the other side tooth surface thereof being formed as an inclined surface. Preferably, the locking pin 212 is formed with a corresponding vertical surface and a corresponding inclined surface at its end for engaging with the locking groove 2046 so that a single directional lock of the nail-storing element 204 can be obtained. As shown in FIG. 5, the locking groove 2046 is corresponding to the skewed slot 2041 one to one, specifically, when the pin 211 is positioned in the opening of the first skewed slot 2041, the locking pin 212 is locked in a first locking groove 2046, and when the pin 211 is impelled inwards to the skewed slot 2041, the locking pin 212 slides out of the first locking groove 2046 gradually along the inclined surface of the locking tooth 2043 until the pin 211 is retreated back to the opening of the second skewed slot 2041, then, the locking pin 212 is moved to a second adjacent locking groove 2046, the nail-storing element 204 is locked in a single direction again.

It can be seen that, the nail 1' to be struck, which is arranged in the nail-storing element 204, is perpendicular to the direction of the striking rod 12. In order to make the nail 1' rotate to a position for striking where the nail 1' is parallel to the striking rod, a rotating mechanism in the form of rack-pinion engagement is adopted in the preferred embodiment. The rack portion 2031 is formed on the driving part 203, and the pinion portion 2071 is formed on the rotary element 207. The length of the rack portion 2031 or the radian of the pinion portion 2071 can ensure that the extension arm 2072 on the rotary element 207 can be rotated just 90 degrees.

The rotating mechanism of the present invention is not limited to the rack-pinion mechanism. In other embodiments, it may also adopt a turbine-worm mechanism, a link rod mechanism or a cam mechanism to achieve the rotation movement of the rotary element 207 through the reciprocating movement of the driving part 203.

Figure 9:
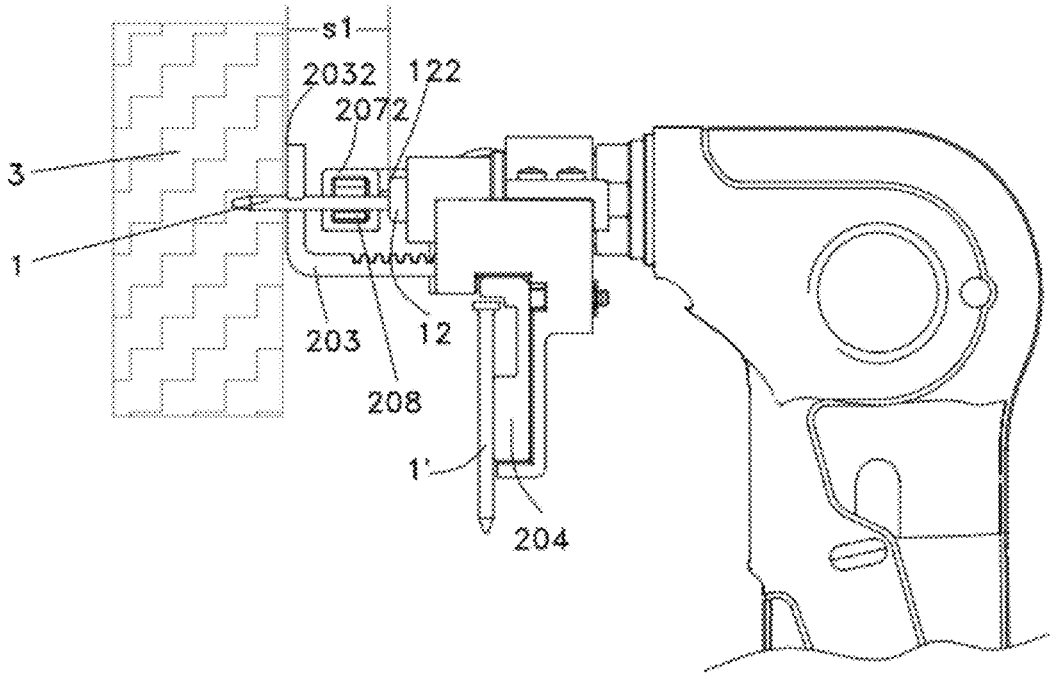
FIG. 9 is a schematic view showing the automatic nail-feeding mechanism in a first state during striking of a nail.
Figure 10:
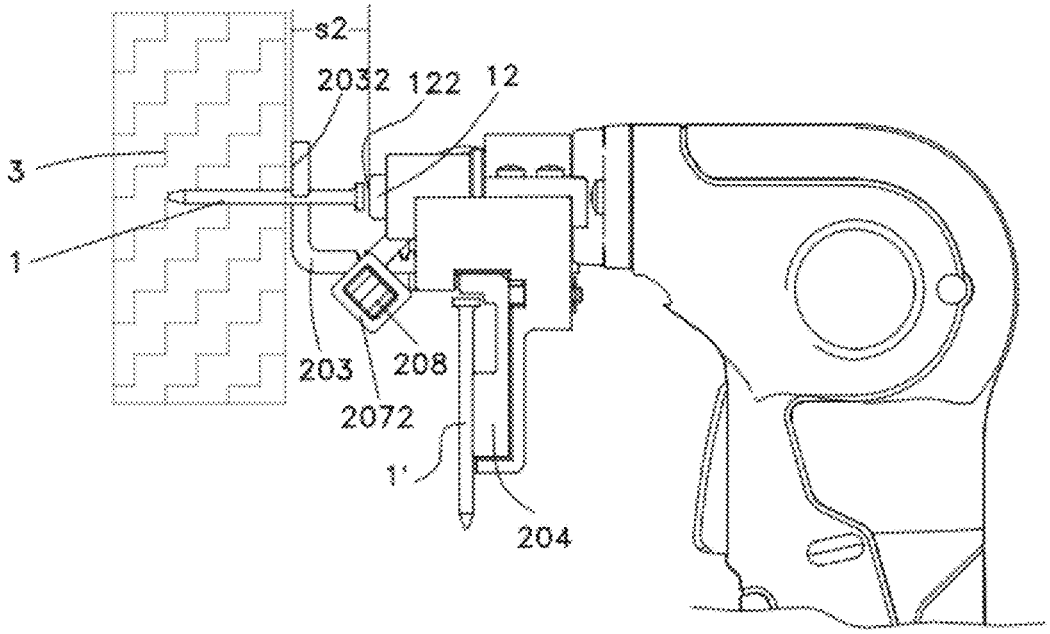
FIG. 10 is a schematic view showing the automatic nail-feeding mechanism in a second state during striking of the nail.
Figure 11:
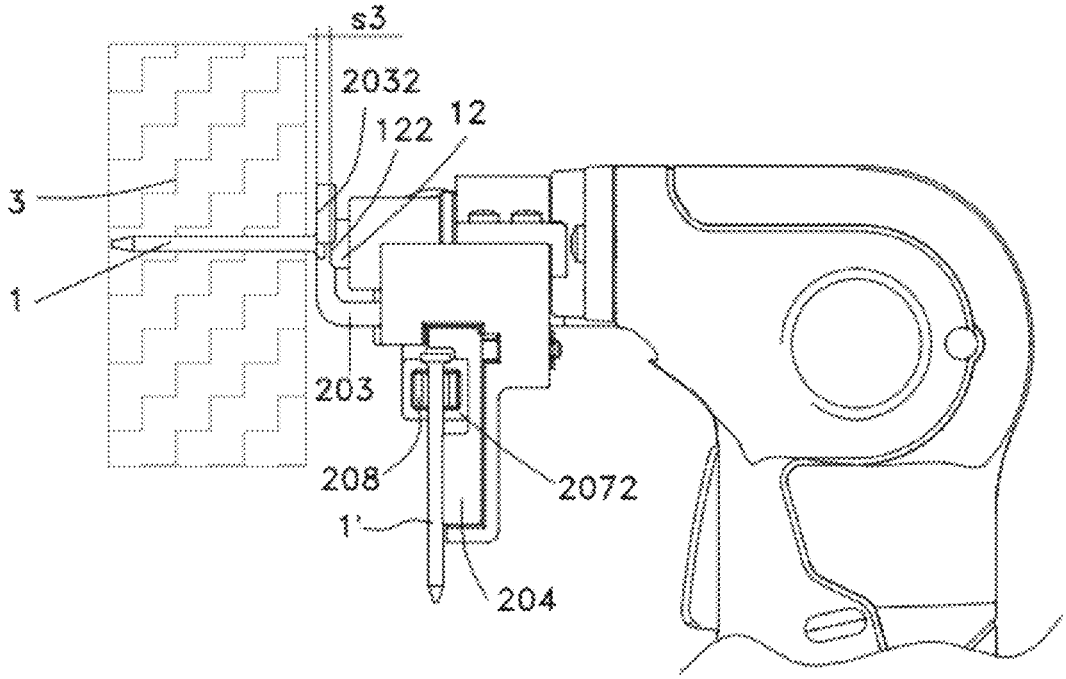
FIG. 11 is a schematic view showing the automatic nail-feeding mechanism in a third state during striking of the nail.

Referring to FIGS. 9-11, the nail-feeding principle of the automatic nail-feeding mechanism at the front end of the power tool according to the preferred embodiment of the present invention will be explained hereinbelow. First, the nail 1 to be stricken is held in its stricken position by the magnetic element 208. After being struck by the striking rod 12 multiple times, the nail 1 enters into the workpiece 3 gradually. During the process of striking, the front end surface 2032 of the driving part 203 comes into contacting with the workpiece 3 first, at this time, the front end surface 2032 of the driving part 203 is at a farthest distance S1 from the front end surface of the striking rod 12. Then, the driving part 203 is impelled backwards by the workpiece. In this case, the rack portion 2031 on the driving part 203 drives the pinion portion 2071 and then the rotary element 207 to rotate, so that the extension arm 2072 of the rotary element 207 and the magnetic element 208 arranged in the extension arm 2072 is rotated towards the next nail 1' to be struck in the nail-storing element 204. At this time, the front end surface 2032 of the driving part 203 is at a distance S2 from the front end surface 122 of the striking rod 12. When the driving part 203 is impelled further by the workpiece 3 and the front end surface 2032 of the driving part 203 is at a smallest distance S3 from the front end surface 122 of the striking rod 12, the nail 1 is completely struck into the workpiece 3. At this time, the extension arm 2072 as well as the magnetic element 208 arranged thereon has rotated to a position where they are perpendicular to the striking rod 12, that is, they are parallel with the nail 1' to be struck which is filled in the nail-storing element 204, in this case, the magnetic element 208 comes to attract the nail 1' to be struck. Meanwhile, the pin 211 is driven by the driving part 203 to move from the front end of the skewed slot 2041 to the rear end thereof. Once the electric hammer is taken away from the workpiece 3, the driving part 203 and the rotary element 207 will be restored under the action of the restoring spring (the second spring and/or the third spring), as a result, the pin 211 slides from the rear end of the skewed slot 2041 into the front end of next adjacent skewed slot 2041 for a next nail-feeding cycle.

Before the nailing operation, the users may arrange the nails 1' to be stricken in the nail-retaining groove 2045 according to the practical requirements. Preferably, the nail-storing element 204 is provided with magnetic material for attracting the nails 1' to be struck in the nail-retaining groove 2045, wherein the magnetism of the magnetic material is less than that of the magnetic element 208 arranged on the extension arm 2072.

What is claimed is:

1. A power tool with an automatic nail-feeding mechanism, comprising:

a striking assembly having a striking rod movable in a linear reciprocating manner; and an automatic nail-feeding mechanism for automatically feeding a nail to be struck to a front end of the striking rod the automatic nail-feeding mechanism comprising a driving part movable between a first position and a second position in a direction of reciprocating motion of the striking rod;

a nail-storing element provided with nails arranged at a fixed pitch, the nail-storing element being fed a distance of the fixed pitch towards the striking rod when the driving part moves from the first position to the second position and then from the second position to the first position in a stroke of the reciprocating motion thereof; and a feed mechanism drivably arranged between the driving part and the nail-storing element, the feed mechanism comprising guide grooves and a driving element engagable with the guide grooves.

2. The power tool with an automatic nail-feeding mechanism according to claim 1, wherein the guide grooves comprise skewed slots formed on the nail-storing element.

3. The power tool with an automatic nail-feeding mechanism according to claim 2, wherein a skewed tooth is formed between two adjacent skewed slots, a tooth surface at one side of the skewed tooth being a vertical surface and a tooth surface at the other side thereof being an inclined surface or a curved surface.

4. The power tool with an automatic nail-feeding mechanism according to claim 1, wherein the driving element comprises a retractable convex piece arranged on the driving part.

5. The power tool with an automatic nail-feeding mechanism according to claim 4, wherein a first spring element acts on the convex piece for biasing it towards the guide grooves.

6. The power tool with an automatic nail-feeding mechanism according to claim 1, wherein the automatic nail-feeding mechanism further comprises a locking mechanism for locking the nail-storing element in a single direction.

7. The power tool with an automatic nail-feeding mechanism according to claim 1, wherein the nails to be struck are arranged on the nail-storing element in a direction perpendicular to the striking rod.

8. The power tool with an automatic nail-feeding mechanism according to claim 7, wherein the automatic nail-feeding mechanism further comprises a rotating mechanism for rotating the nail to be struck from a position where the nail is perpendicular to the striking rod to a position where the nail is parallel to the striking rod.

9. The power tool with an automatic nail-feeding mechanism according to claim 8, wherein the rotating mechanism comprises a rack portion formed on the driving part and a pinion portion formed on a rotary element for engaging with the rack portion.

10. The power tool with an automatic nail-feeding mechanism according to claim 9, wherein the rack portion has such a length that the rotary element is rotatable by an angle of 90 degrees.

11. The power tool with an automatic nail-feeding mechanism according to claim 9, wherein the pinion portion has a first end which comes into engagement with the rack portion at a start of the rack portion and a second end which engages with the rack portion at an end of the rack portion and wherein the first end makes an angle of 90 degrees with the second end.

12. The power tool with an automatic nail-feeding mechanism according to claim 8, wherein the rotating element is provided with an extension arm having a magnetic element thereon.

13. The power tool with an automatic nail-feeding mechanism according to claim 12, wherein the first position is a position where a front end surface of the driving part is farthest from a front end surface of the striking rod, and the second position is a position where the front end surface of the driving part is nearest to the front end surface of the striking rod, the automatic nail-feeding mechanism further comprising a second spring element for biasing the driving part towards the first position.

14. The power tool with an automatic nail-feeding mechanism according to claim 12, wherein the automatic nail-feeding mechanism further comprises a third spring element for allowing for a reverse rotation of the rotary element.

* * * * *